US005141218A

United States Patent [19]

Umetani

[11] Patent Number: 5,141,218

[45] Date of Patent: Aug. 25, 1992

[54] SHEET FEEDER

[75] Inventor: Yoichi Umetani, Izumi, Japan

[73] Assignee: Umetani Mfg. Co., Ltd., Osaka, Japan

[21] Appl. No.: 760,197

[22] Filed: Sep. 16, 1991

[30] Foreign Application Priority Data

Sep. 18, 1990 [JP] Japan ..... 2-251263

[51] Int. Cl.[5] ..... B65H 3/12

[52] U.S. Cl. ..... 271/94; 271/104; 271/35; 271/165; 271/171

[58] Field of Search ..... 271/35, 94, 96, 99, 271/104, 112, 132, 137, 144, 165, 167, 171; 414/797.6, 797.9

[56] References Cited

U.S. PATENT DOCUMENTS

| | | | |
|---|---|---|---|
| 3,981,494 | 9/1976 | Prestegaard . | |
| 4,181,298 | 1/1980 | Capdeboscq | 271/35 |
| 4,867,433 | 9/1989 | Wells et al. . | |
| 4,889,331 | 12/1989 | Sardella | 271/94 |
| 4,915,369 | 4/1990 | Rutishauser | 271/35 |

FOREIGN PATENT DOCUMENTS

| | | |
|---|---|---|
| 1139513 | 11/1962 | Fed. Rep. of Germany . |
| 2239881 | 7/1973 | France . |
| 7402469 | 8/1974 | France . |
| 2013630 | 1/1979 | United Kingdom . |

*Primary Examiner*—H. Grant Skaggs
*Attorney, Agent, or Firm*—Klauber & Jackson

[57] ABSTRACT

A sheet feeder including a fixed gate provided on a base and approximately orthogonal to the direction of feed of sheets, and a movable guide plate provided on the base in parallel to the fixed gate movably toward and away from the fixed gate and positionable in place. The feeder kicks out sheets stacked up between the gate and the guide plate one by one from the lowermost position by a suction device and a kicker. The feeder comprises guide members arranged side by side above the base and orthogonal to the gate, a slide member integral with the guide plate and disposed over the guide members thereacross movably toward and away from the gate, and belts each provided on its surface with a kicker member for engaging one end of the sheet and revolvably disposed within a belt support. The belt support is disposed between adjacent guide members, attached to the slide member and communicates with the suction device. The sheets can be kicked out one by one by the kicker member on each belt which is driven in revolution in a specified position, with suction applied at least locally on the lower surface of the sheet.

7 Claims, 6 Drawing Sheets

SHEET FEEDER

FIELD OF INDUSTRIAL APPLICATION

The present invention relates to a sheet feeder for kicking out stacked-up thick sheets one by one from the lowermost position.

BACKGROUND OF THE INVENTION

In the carton production process, a printer slotter is used for printing on corrugated fiberboards and die-cutting and creasing the boards.

FIGS. 6 and 7 show a sheet feeder for use in feeding corrugated fiberboards, i.e., sheets, to the printer slotter.

The sheet feeder includes a fixed gate 4 disposed at the front end of a base 1, and a movable guide plate 41 positionable in place and movable toward and away from the fixed gate. Thick sheets S stacked up between the fixed gate 4 and the movable guide plate 41 are kicked out toward the printer slotter one by one from the lowermost position of the stack by a kicker 10 and a suction device (not shown) on the base 1.

The kicker 10 has a kicker plate 14 slidably provided on the base 1 and reciprocatingly movable by a crank 9. When the kicker plate 14 advances toward the fixed gate 4, an engaging portion 15 of the plate 14 engages the rear end of the lowermost sheet to kick out the sheet. Usually, the suction device applies suction at least locally on the lower surface of the lowermost sheet so that the sheet can be smoothly kicked out even if warped.

The kicker plate 14 and the movable guide plate 41 are coupled to positioning mechanisms 7, 70, respectively, for positioning these plates in place on the base 1 with respect to the direction of feed of the sheet in accordance with the width of the sheet.

The positioning mechanism 70 for the movable guide plate 41 comprises a pair of parallel screw rods 43, 43 arranged on opposite sides of the base 1 and coupled to drive means (not shown). The screw rod 43 extends through, and is in screw-thread engagement with, a leg 42 projecting from each end of the movable guide plate 41.

When the screw rods 43 are rotated in a positive or reverse direction as required, the movable guide plate 41 can be brought to the desired position by the thrust of screw.

Like the positioning mechanism 70 for the guide plate 41, the positioning mechanism 7 for the kicker plate 14 utilizes screw thrust, whereas since the kicker plate 14 as positioned in place needs to move reciprocatingly for kicking out sheets, the entire positioning mechanism 7 is reciprocatingly movable with the kicker plate 14. Screw rods 17, 17 are slidably and rotatably arranged in parallel to the screw rods 43, 43 inwardly thereof. The screw rod 17 extends through, and is in screw-thread engagement with, a leg 16 projecting from the kicker plate 14.

A gear 18 is mounted on a front portion of the screw rod 17. A spline shaft 95 disposed below the screw rod 17 slidably carries thereon a drive gear 94 meshing with the gear 18 on the screw rod 17. A support plate 93 is rotatably fitted around the boss of the drive gear 94 and is movable with the drive gear 94 axially of the spline shaft 95. The support plate 93 has an upper end supporting the front end of the screw rod 17.

The crank 9 for reciprocatingly driving the kicker plate 14 is connected to a lever 91 by a link 90. The lever 91 has a free end which is connected to the support plate 93 by a link 92.

The kicker plate 14 is reciprocatingly moved relative to the base 1 to kick out the sheets S one by one by the rotation of the crank 9 which is transmitted through the link 90, lever 91, link 92, support plate 93, screw rod 17 and leg 16.

The spline shaft 95, when rotated, causes the drive gear 94 and the gear 18 to rotate the screw rod 17, advancing or retracting the leg 16, i.e., the kicker plate 14, whereby the kicking start position of the kicker plate 14 can be adjusted in accordance with the size of the sheet S.

The amount of kicking-out of the sheet S by the kicker plate 14 corresponds to the distance from the fixed gate 4 to feed rollers 81, 81 of the printer slotter. When delivered to the feed rollers 81, 81, the sheet S is transported toward a plate cylinder 82 by the rotation of the feed rollers 81, 81 for printing.

However, the movable guide plate 41 must be held in a position after the position has been determined with respect to the feed direction, and the kicker plate 14 needs to be reciprocatingly movable from a position which has been determined with respect to the feed direction. It is therefore impossible to use a single system for driving both the positioning mechanism 70 for the movable guide plate 41 and the positioning mechanism 7 for the kicker plate 14. Accordingly, the conventional feeder has the problem of being complex in the construction of the drive systems used.

Further in the case where the kicker plate 14 is reciprocatingly driven by the crank 9, the sheet S is delivered to the rollers 81, 81 at the moment when the speed of movement of the kicker plate 14 is greatest. During one turn of rotation of the crank 9, about ¼ of the rotation is then effectively utilized for feeding the sheet S, hence a low efficiency. Additionally, the actual stroke length of the kicker plate 14 needed is about twice the distance from the kicking-out start position to the nip of rollers 81, 81. This results in the drawback that the lever 91 must be made swingingly movable over a large distance.

The conventional feeder has another drawback. The arrangement wherein the support plate 93, the drive gear 94 and the screw rod 17 are moved with the kicker plate 14 requires a large means (not shown) for rotating the crank 9, consequently producing increased vibration during the reciprocating movement of the kicker plate 14.

While the sheet is delivered to the rollers 81, 81 approximately when the speed of kicking-out of the sheet by the kicker plate 14 is the highest, it is likely that the sheet will be propped against the nip of the rollers 81, 81 by the kicker plate 14. This must be prevented by causing the rollers 81, 81 to pull out the sheet S at a higher speed than the kicking-out speed of the kicker plate 14.

The present invention, which has been accomplished in view of the above situation, provides a sheet feeder which is adapted to kick out sheets by belts having kicker members and movable in revolution in a fixed position instead of the reciprocatingly movable kicker plate so that the sheet can be kicked out with a small torque and with diminished vibration, the sheet feeder having a simplified mechanism for positioning the kicker members and a movable guide plate in place with respect to the direction of feed of the sheet.

SUMMARY OF THE INVENTION

The present invention provides a sheet feeder including a fixed gate provided on a base and approximately orthogonal to the direction of feed of sheets, and a movable guide plate provided on the base in parallel to the fixed gate movably toward and away from the fixed gate and positionable in place, the sheet feeder being adapted to kick out thick sheets stacked up between the fixed gate and the movable guide plate one by one from the lowermost position by suction means and a kicker, the sheet feeder comprising a plurality of guide members arranged side by side above the base and orthogonal to the fixed gate, a slide member integral with the movable guide plate and disposed over the guide members thereacross movably toward and away from the fixed gate, a plurality of belt supports arranged between the guide members, attached to the slide member and communicating with the suction means, a plurality of belts each revolvably disposed within the belt support and provided on its surface with a kicker member for engaging one end of the sheet, drive means for driving the belts in revolution, and a positioning mechanism coupled to the slide member for positioning the slide member in place relative to the fixed gate with respect to the feed direction.

When an additional suction box opened at its upper side is provided as projected downward from the guide members, the sheet can be advanced while being held in intimate contact with the guide members by suction applied at least locally on the lower surface of the sheet through the suction box. The sheet can then be kicked out reliably even if warped. The additional suction box may be in communication with the belt supports or independent of the belt supports.

DESCRIPTION OF THE PREFERRED EMBODIMENTS

Figure 1:
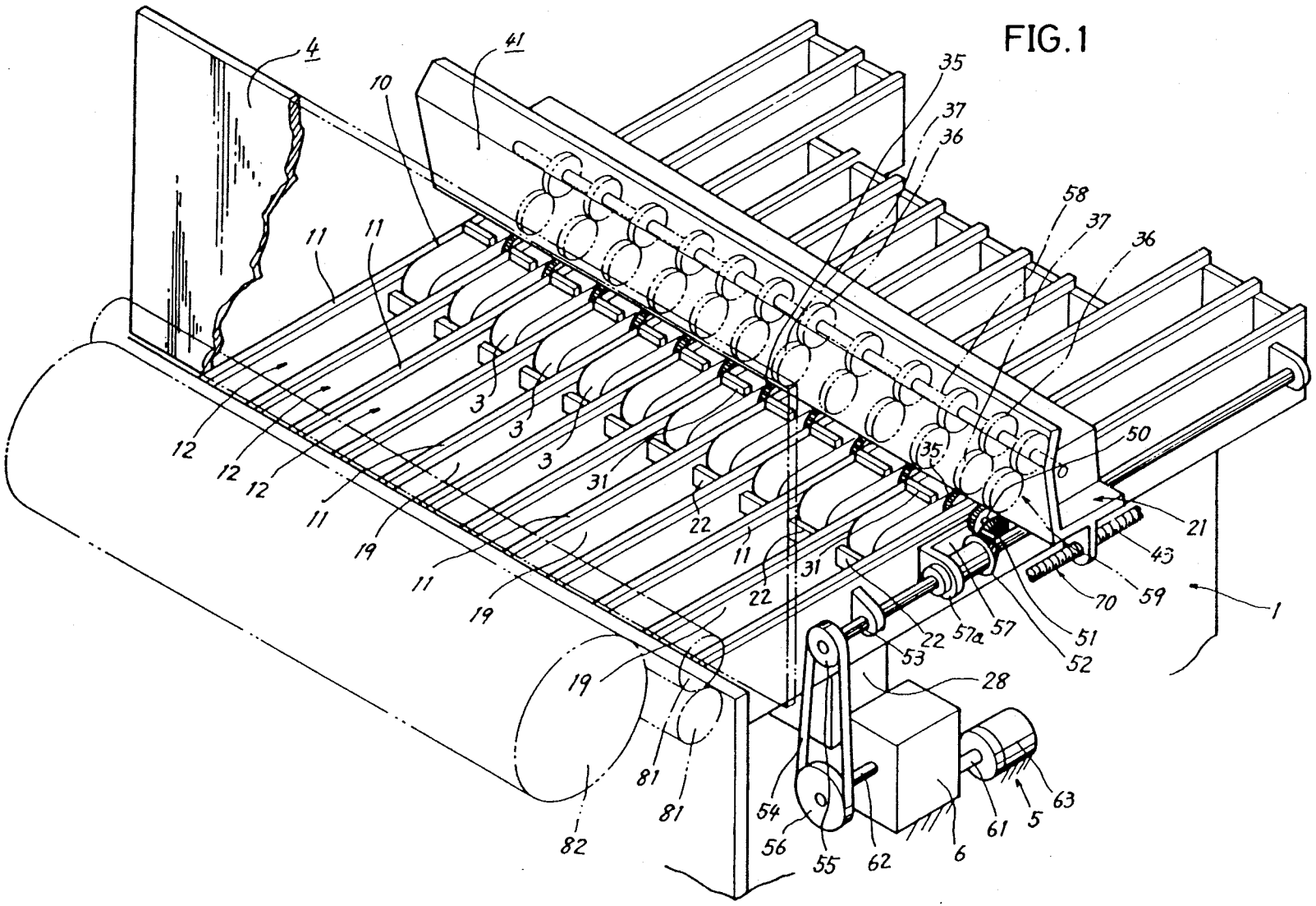
FIG. 1 is a perspective view showing a sheet feeder as a first embodiment of the invention.

FIG. 1 shows a sheet feeder embodying the present invention as it is seen from one side thereof close to a printer slotter having feed rollers 81, 81 and a plate cylinder 82. With this embodiment, an additional suction box 12 is provided in communication with belt supports 22.

The term "front" as used in the following description refers to the direction of feed of sheets by the feeder, i.e., the direction toward the feed rollers 81, 81.

The sheet feeder has the above-mentioned suction box 12 opened at its upper side and mounted on a base 1. The suction box 12 is equidistantly divided by partitions 19 in a direction orthogonal to the feed rollers 81. A guide member 11 in the form of a rod of square cross section is mounted on the upper end of each partition 19.

A suction duct 28 parallel to the feed rollers 81 and constituting part of a suction device 2 is attached to the bottom of the suction box 12 at a position closer to the front end of the box. The suction box 12 is in communication with the suction duct 28 through apertures 24 formed in the bottom wall of the box. The suction duct 28 communicates with a suction pump (not shown) through a flexible duct 25.

Each aperture 24 is removably provided with a closure 13. In accordance with the width of the sheet S to be fed, the apertures 24 not participating in the application of suction to the sheet are closed with closures 13 to ensure an improved suction efficiency.

A slide member 21 slidably extends over the guide members 11 at right angles therewith. A movable guide plate 41 extends upward from the front edge of the slide member 21.

A fixed gate 4 is provided above the front ends of the guide members 11 and spaced apart therefrom by a distance slightly larger than the thickness of the sheet S.

A plurality of belt supports 22 are fixed to the bottom of the slide member 21 and are therefore slidable with the slide member 21. Each of the belt supports 22 is in the form of a box which is open at its upper and lower sides. The upper edge defining the upper opening is lower than the guide members 11. The lower opening is in communication with the suction device 2 through the suction box 12. Front and rear two toothed pulleys 33, 34 are provided in and supported by the belt support 22. A toothed endless belt 3 having a large width is reeved around the two pulleys 33, 34.

A clearance is formed between at least one side edge of the belt 3 and the support 22. Since the upper edge of the support 22 is at a lower level than the guide members 11 as stated above, a suction force acts on the sheet through this clearance. Preferably, the clearance is formed between each side edge of the belt and the support 22.

The rear toothed pulley 34 is provided with a gear 35 as mounted on the same shaft as the pulley and is coupled to belt drive means 5.

The belt 3 has two kicker members 31, 31 positioned symmetrically and projecting outward therefrom for engaging one end of the sheet.

The kicker members 31 on the belts 3 are in phase, and the transport surfaces of the belts 3 are substantially flush with the upper surfaces of the guide members 11. The kicker members 31 are positionable as projected beyond the supper surfaces of the guide members 11.

The drive means 5 for driving the belts 3 in revolution is adapted for intermittent indexing rotation by a known indexing drive 6. A spline shaft 53 rotatably extends alongside the suction box 12. A bracket 57 fixed at its one end to the slide member 21 has at the other end thereof a bent portion 57*a* which is loosely fitted around the spline shaft 53.

A drive bevel gear 52 slidably mounted on the spline shaft 53 is in mesh with a driven bevel gear 51 supported by a shaft 50 on the bracket 57.

A countershaft 58 is mounted on the slide member 21 and extends longitudinally thereof. Via a train of gears 59, the countershaft 58 is coupled to the rotary shaft 50 of the driven bevel gear 51. The countershaft 58 fixedly carries gears 36 as positioned in corresponding relation with the respective gears 35 for the belts 3. Each gear 35 is coupled to the gear 36 opposed thereto by an intermediate gear 37.

The slide member 21 is moved forward or rearward in conformity with the sheet S by rotating the screw rods 43 of the same positioning mechanism 70 as already described. At this time, the belt supports 22 including the belts 3, the bevel gear 51 on the bracket 57 and the bevel gear 52 on the spline shaft 53 move forward or rearward with the slide member 21, with the gears held in mesh with each other. Consequently, the rotation of the spline shaft 53 can be properly transmitted to the belts 3 via the bevel gears 52, 51, gear train 59, countershaft 58 and gears 36, 37, 38.

The indexing drive 6 has an output shaft 62 which is coupled to one end of the spline shaft 53 via a timing pulley 55, timing belt 54 and timing pulley 56. The indexing drive 6 has an input shaft 61 which is connected to the motor 63.

The indexing drive 6 has incorporated therein a cam having a modified sine curve so as to drive the belts 3 in revolution in the following manner. The kicker member 31 on each belt 3 slowly starts to kick out the sheet S, is given a maximum speed when delivering the sheet to the feed rollers 81, 81, then slows down gradually and comes to a stop momentarily. The belt thereafter starts to kick out another sheet again.

Figure 2:
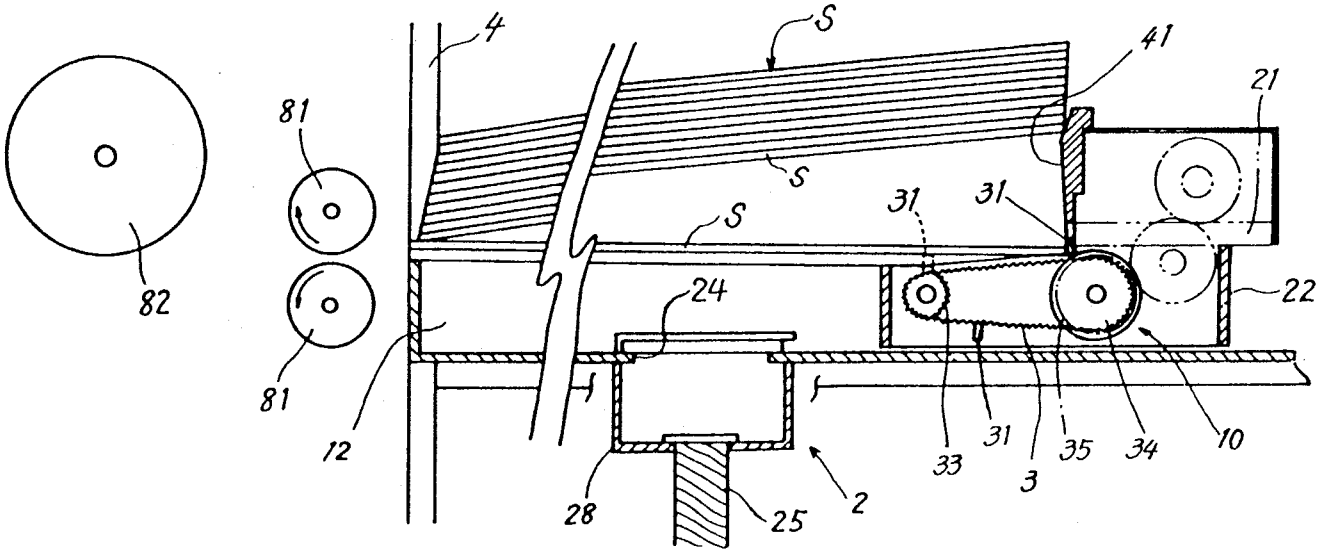
FIG. 2 is a fragmentary sectional view of the embodiment shown in FIG. 1.

With the present embodiment, the belt 3 stops in a moment with the upper kicker member 31 as shown in FIG. 2 positioned above the rear pulley 34 and with the lower kicker member 31 positioned under the front pulley 33.

Upon the upper kicker member 31 in this state reaching the position above the front pulley 33 as indicated in a broken line while kicking out the sheet S, the belt delivers the sheet S to the feed rollers 81, 81. The belt stops in a moment upon the member 31 reaching the position under the front pulley 33.

Each sheet S is thus kicked out by every half of revolution of the belts 3.

The lowermost of the sheets S stacked up between the fixed gate 4 and the movable guide plate 41 is engaged at its rear end by the kicker member 31 on each belt while the belt revolves intermittently, whereby the sheets S are successively kicked out one by one.

Through the upper openings of the suction box 12 and the belt supports 22, suction is applied to the sheet S approximately over the entire lower surface thereof to hold the sheet in intimate contact with the guide members 11, and in this state, kicker members 31 come into contact with the rear end of the sheet and kick out the sheet. This eliminates disengagement of the rear end of the sheet S from the kicker member 31. Even if warped, the sheet is therefore slidingly moved on the guide members 11 in intimate contact therewith and delivered to the feed rollers 81, 81 with good stability.

The sheets S are kicked out successively, one sheet by every intermittent movement of the belts 3.

The intermittent drive means 5 need not reciprocatingly drive a large assembly of members unlike the conventional crank drive system and is therefore operable with a reduced torque and diminished vibration.

With the present feeder, there is no need to reciprocatingly move the kicker plate 14 included in the conventional kicker 10, so that the positioning mechanism 70 only is provided for the slide member 21 which has the movable guide plate 14 integral and slidable therewith. Thus ensures a simplified construction.

The belt drive means 5 comprises the indexing drive 6 which converts the rotation of the motor 63 to intermittent indexing rotation and which includes a cam having a modified sine curve. This gives the belts a low speed for starting a kicking movement and a maximum speed when the sheet is to be delivered to the feed rollers 81, 81, with the result that sheets can be kicked out efficiently and smoothly without causing damage to the sheet end.

Furthermore, the suction box 12 provided at the top of the base 1 serves to prevent fragments of sheets and the like from falling into the base.

Figure 4:
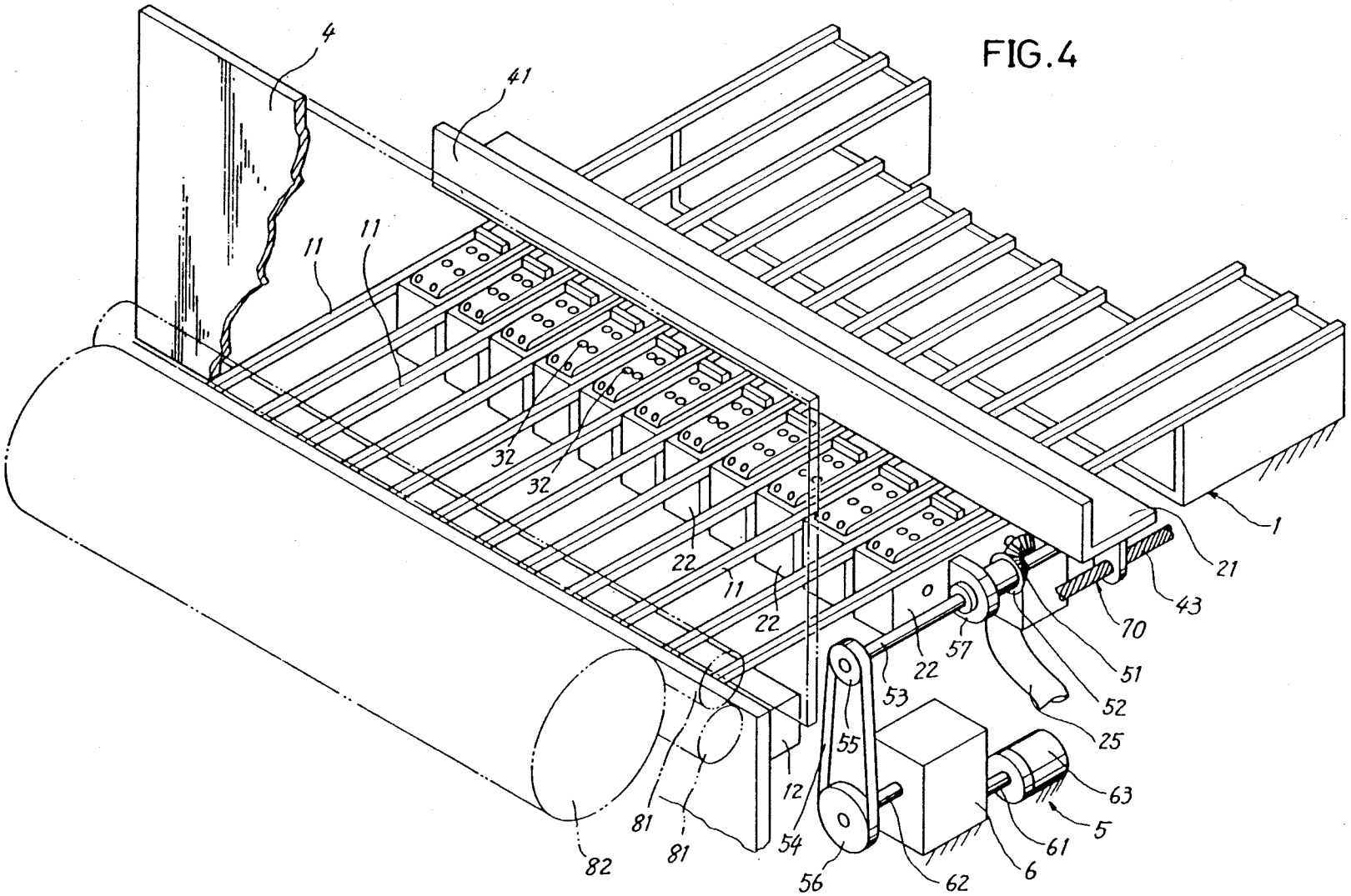
FIG. 4 is a perspective view of a sheet feeder as another embodiment of the invention.
Figure 3:
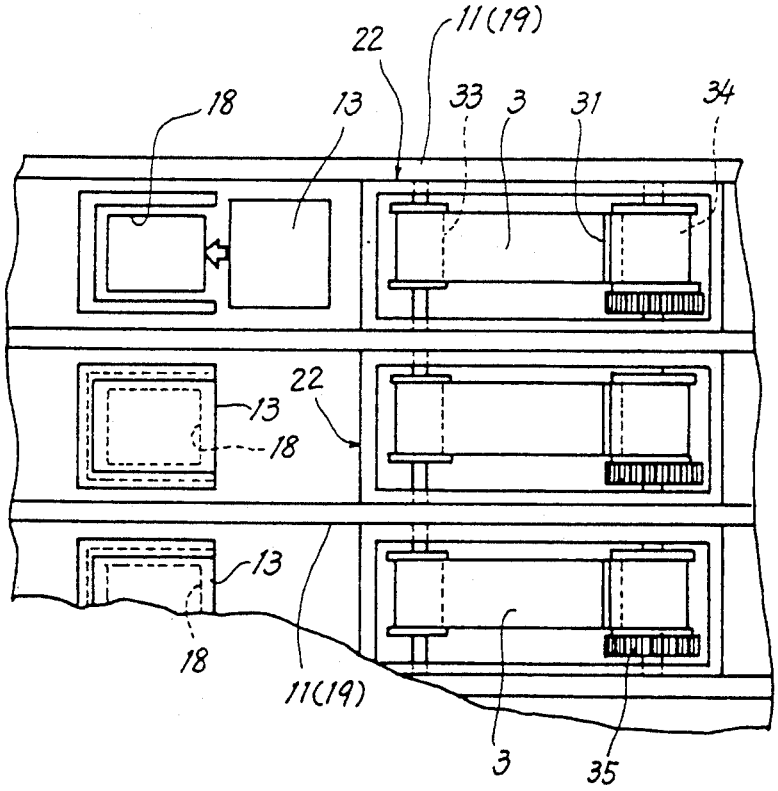
FIG. 3 is a fragmentary plan view of the embodiment shown in FIG. 1.
Figure 5:
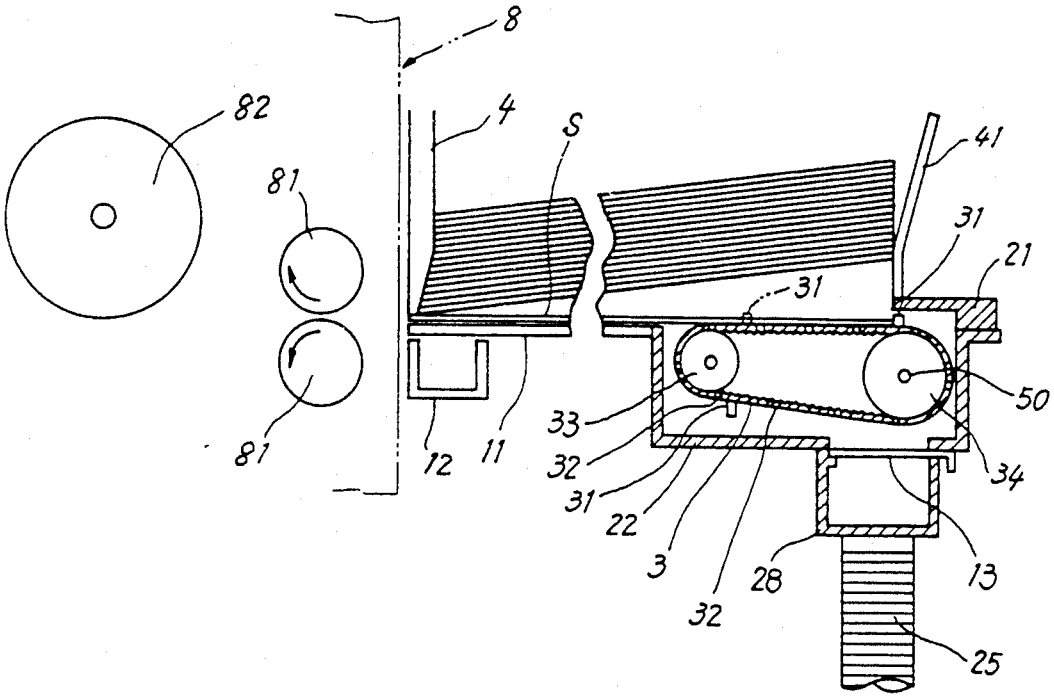
FIG. 5 is a fragmentary sectional view of the embodiment shown in FIG. 4.
Figure 6:
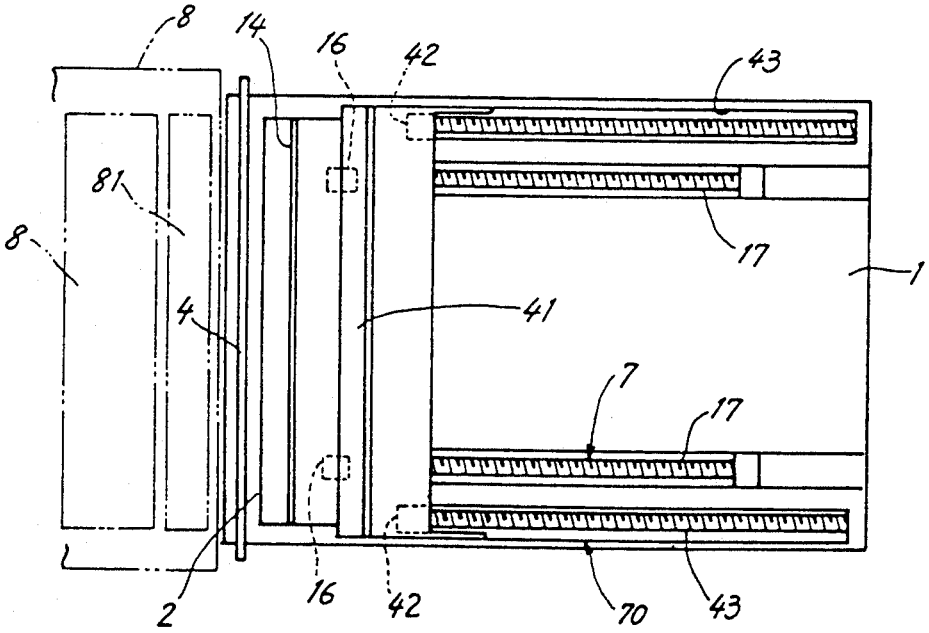
FIG. 6 PRIOR ART
FIG. 6 is a plan view of a conventional sheet feeder.
Figure 7:
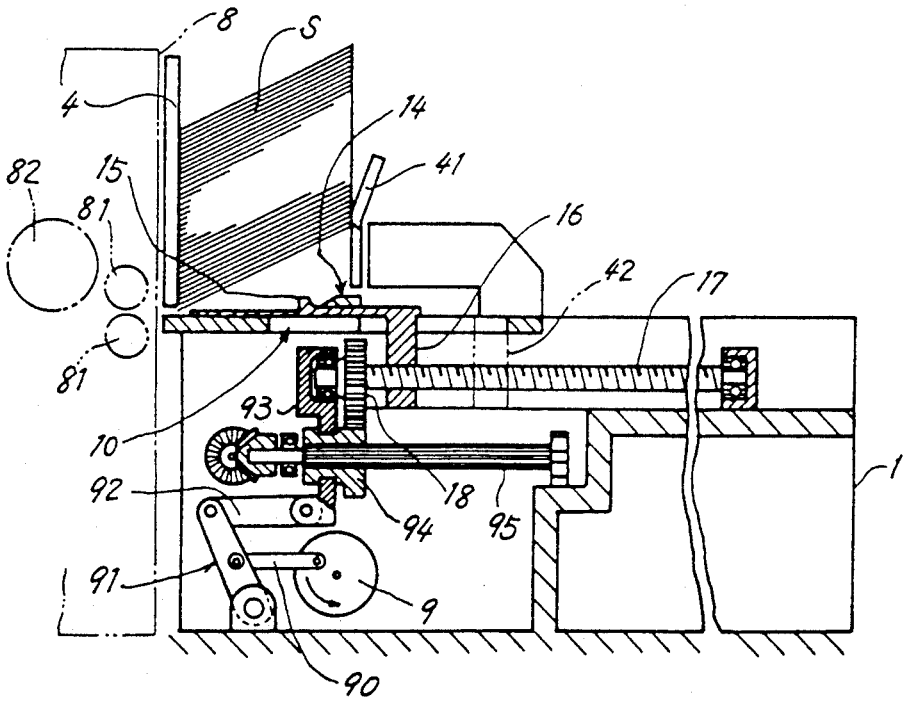
FIG. 7 PRIOR ART
FIG. 7 is a sectional view of the conventional sheet feeder.

FIGS. 4 and 5 show another sheet feeder embodying the present invention, in which the additional suction box 12 is provided independently of the belt supports 22.

The additional suction box 12, which is opened at its upper side, is disposed under the front ends of the guide members 11 at right angles with the members 11 and communicates with a suction pump (not shown). Through the suction box 12, suction acts on the front end portion of the lowermost sheet S, whereby the sheet front end is prevented from coming into engagement with the fixed gate 4.

Each belt support 22 is open at its upper side and attached to the bottom of the slide member 21 so as to be slidable between the adjacent guide members 11. The bottom portion of the support 22 is in communication with an elongated suction duct 28 extending along the slide member 21 and with a suction pump (not shown) through a flexible duct 25. A suction clearance may be provided between the side edge of the belt 3 and the support 22 as in the first embodiment, whereas a multiplicity of suction apertures 32 may be formed in the belt 3 as seen in FIG. 4.

The present invention is not limited to the foregoing embodiments but can be modified variously within the scope of the appended claims.

What is claimed is:

1. A sheet feeder including a fixed gate provided on a base and approximately orthogonal to the direction of feed of sheets, and a movable guide plate provided on the base in parallel to the fixed gate movably toward and away from the fixed gate and positionable in place, the sheet feeder being adapted to kick out sheets stacked up between the fixed gate and the movable guide plate one by one from the lowermost position by suction means and a kicker, the sheet feeder being characterized in that the feeder comprises:

a plurality of guide members arranged side by side above the base and orthogonal to the fixed gate, a slide member integral with the movable guide plate and disposed over the guide members thereacross movably toward and away from the fixed gate, a plurality of belt supports arranged between the guide members, attached to the slide member and communicating with the suction means, a plurality of belts each revolvably disposed within the belt support and provided on a surface thereof with a kicker member for engaging one end of the sheet, drive means for driving the belts in revolution, and a positioning mechanism coupled to the slide member for positioning the slide member in place relative to the fixed gate with respect to the feed direction.

2. The sheet feeder as defined in claim 1 wherein a suction box opened at its upper side is provided as projected downward from the guide members so that the sheet can be advanced with suction applied at least locally on the lower surface of the sheet through the suction box.

3. The sheet feeder as defined in claim 2 wherein the suction box is in communication with the belt supports.

4. The sheet feeder as defined in claim 2 wherein the suction box is provided independently of the belt supports.

5. The sheet feeder as defined in claim 1 wherein a suction clearance is formed between at least one side edge of each belt and the belt support.

6. The sheet feeder as defined in claim 1 wherein a plurality of suction apertures are formed in each belt.

7. The sheet feeder as defined in claim 1 wherein the drive means comprises an indexing drive for converting rotation of a motor to intermittent indexing rotation, and the indexing drive includes a cam having a modified sine curve.

* * * * *